US007302217B2

(12) United States Patent
Takiguchi et al.

(10) Patent No.: US 7,302,217 B2
(45) Date of Patent: Nov. 27, 2007

(54) IMAGE FORMING APPARATUS AND TRANSFER APPARATUS EMPLOYING ENDLESS BELT

(75) Inventors: Toshiki Takiguchi, Nara (JP); Yoshiaki Masuda, Nara (JP); Fumio Shimazu, Nara (JP); Hiroyuki Murai, Nara (JP); Hirokazu Yamauchi, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 73 days.

(21) Appl. No.: 11/225,438

(22) Filed: Sep. 12, 2005

(65) Prior Publication Data

US 2006/0056885 A1 Mar. 16, 2006

(30) Foreign Application Priority Data

Sep. 14, 2004 (JP) ..... 2004-267268

(51) Int. Cl.
*G03G 15/20* (2006.01)

(52) U.S. Cl. ..... 399/310; 399/312; 399/313; 399/314

(58) Field of Classification Search ..... 399/312, 399/313, 314, 310
See application file for complete search history.

(56) References Cited

U.S. PATENT DOCUMENTS 5,873,016 A * 2/1999 Kurokawa et al. ..... 399/297
6,167,229 A * 12/2000 Watanabe et al. ..... 399/313
6,178,307 B1 * 1/2001 Kimura ..... 399/303

FOREIGN PATENT DOCUMENTS

| | | |
|---|---|---|
| JP | 04-042277 | 2/1992 |
| JP | 07-199689 | 8/1995 |
| JP | 10-260624 | 9/1998 |
| JP | 11-288179 | 10/1999 |
| JP | 2000-147950 | 5/2000 |

* cited by examiner

*Primary Examiner*—David M. Gray
*Assistant Examiner*—Joseph S. Wong
(74) *Attorney, Agent, or Firm*—David G. Conlin; David A. Tucker; Edwards Angell Palmer & Dodge LLP

(57) ABSTRACT

Transfer roller(s) is/are such that either end thereof is formed from fibrous electrically conductive component(s) and such that cylindrical portion(s) in central region(s) is/are, for example, formed from metal roller-like structure(s), either fibrous electrically conductive component outer end being arranged so as to extend somewhat beyond either transfer/transport belt side. Furthermore, outside diameter(s) approximated by tips of respective individual fiber(s) of fibrous electrically conductive component(s) is/are somewhat larger than diameter(s) of metal roller-like structure(s). This makes it possible for electric field(s) to be applied, and for charging to occur, along the full width(s) of transfer/transport belt(s).

13 Claims, 5 Drawing Sheets

Frame
Terminal for applying voltage
A
L3
L2
51a
L1
51
53a1
53b1
53b2
53b
53a
53
63a
63
B
T1
T2

IMAGE FORMING APPARATUS AND TRANSFER APPARATUS EMPLOYING ENDLESS BELT

BACKGROUND OF INVENTION

This application claims priority under 35 USC 119(a) to Patent Application No. 2004-267268 filed in Japan on 14 Sep. 2004, the content of which is hereby incorporated herein by reference in its entirety.

The present invention relates to copiers, facsimile machines, printers, and other electrophotographic image forming apparatuses; more particularly, the present invention pertains to a transfer apparatus employing endless belt(s) with which image forming apparatus(es) may be equipped.

Image forming apparatuses making use of endless belts have become widespread in recent years. Furthermore, endless belts are frequently utilized within image forming apparatuses at fuser apparatuses, transfer apparatuses, processing units, and the like.

For example, along with the increased speeds of color image forming apparatuses that have undergone rapid development in recent years, endless belts have been used as intermediate transfer bodies in the context of a technique in which image information that has been separated into respective hues is temporarily transferred to intermediate transfer body/bodies, such image information being printed in stacked fashion on intermediate transfer body/bodies, and these are all retransferred together from the intermediate transfer body/bodies on which such stacked printing was carried out and onto paper that is transported thereto from media supply tray(s). Furthermore, at transfer units which transfer developer to paper, endless belts are frequently used to improve transportability (i.e., tendency of paper to separate from photosensitive drum(s)) of paper that is transported thereto from media supply tray(s).

Endless belts utilized for such purpose(s) are subjected to application of electric field(s) at necessary region(s) thereof, prescribed electric field(s) causing developer to be transferred to intermediate transfer body/bodies and/or paper.

Such electric field(s) might be applied through utilization of either a technique involving application of electric field(s) under conditions of constant current or a technique involving application of electric field(s) under conditions of constant voltage, electric field application means in either case being constructed so as to employ roller-shaped electrically conductive component(s) (metal roller-like structure(s), roller-like electrically conductive rubber structure(s), etc.) to charge endless belt(s) with prescribed electric field(s) from back(s) of intermediate transfer body/bodies and/or paper.

The locus of contact between electrically conductive component and endless belt at such time is ordinarily such that the dimension in the width direction of the endless belt is greater than the dimension in the width direction of the electrically conductive component. The reason for this is so as to accommodate meander of the endless belt at either extreme side in the belt width direction (hereinafter "side (s)") where the belt extends past the electrically conductive component and so as to compensate for transfer irregularities (e.g., wrinkling) arising due to the thickness of the belt. This being the case, despite application of an electric field to the electrically conductive component, as the sides of the endless belt extend beyond the sides of the electrically conductive component, not only will it be the case that the electric field at the endless belt does not act at either extreme side thereof but it will also be the case that the endless belt, which is under a prescribed amount of tension, will experience no load at either extreme side thereof.

However, because of meander and so forth of the endless belt, for example, developer from the photosensitive drum may, due to the electric potential to which the developer has been charged, also be made to adhere at either extreme side of the endless belt where the applied electric field does not act. Where this is the case, because the electric field does not act at either extreme side of the endless belt when a cleaning technique is employed in which a reverse electric field is applied to the endless belt to cause developer adhering thereto to be transferred back to the photosensitive drum, developer adhering at such locations cannot be cleaned therefrom.

Furthermore, it is common for either end in the width direction (hereinafter "end(s)") of the electrically conductive component to produce bending at either side of the endless belt where there is no load, causing occurrence of cracking, tearing, and so forth toward the end of its service life. Moreover, there has been the problem that the endless belt engages in meander due to the fact that a portion thereof does not experience a load.

Various techniques have therefore been proposed to prevent such meandering of the endless belt.

For example, Japanese Patent Application Publication Kokai No. H04-42277 (1992; hereinafter "Patent Reference No. 1") discloses art in which rib(s) projecting in circumferential direction(s) is/are provided at end(s) of metal roller(s), such rib(s) constraining meander of endless belt(s). Furthermore, Japanese Patent Application Publication Kokai No. H10-260624 (1998; hereinafter "Patent Reference No. 2") discloses art in which thrust member(s) larger in diameter than outside diameter(s) of rubber roller(s) is/are provided at either end of corrective shaft(s), abutment of such thrust member(s) by end(s) of rubber roller(s) permitting prevention of meander. Furthermore, Japanese Patent Application Publication Kokai No. 2000-147950 (hereinafter "Patent Reference No. 3") discloses art in which guide(s) provided at endless belt(s) strike flange(s) at end(s) of roller(s) and/or edge(s) of roller(s) on which such endless belt(s) is/are suspended, permitting prevention of meander.

As mentioned above, when the dimension in the width direction of the endless belt is greater than the dimension in the width direction of the electrically conductive component, the applied electric field will not act at either extreme side of the endless belt. However, because of meander and so forth of the endless belt, for example, developer from the photosensitive drum may, due to the electric potential to which the developer has been charged, also be made to adhere at either extreme side (uncharged region) of the endless belt where the applied electric field does not act. Where this is the case, because the electric field does not act at either extreme side of the endless belt when a cleaning technique is employed in which a reverse electric field is applied to the endless belt to cause developer adhering thereto to be transferred back to the photosensitive drum, it will be the case that developer adhering thereto cannot be cleaned therefrom. Developer adhering at either extreme side of the endless belt will consequently accumulate and this can act as an abrasive to abrade the surface layer of the photosensitive drum. Furthermore, markings in which photosensitive characteristics, manufacturing lot number, and/or the like for the photosensitive drum in question is/are inscribed might, for example, be embedded in portion(s) of the photosensitive drum surface layer located at either extreme side of the endless belt, such markings being capable of being read by optical sensor(s). This being the case, abrasion of the surface layer of the photosensitive drum might cause a problem to occur in which the optical signal is reflected in diffuse fashion at the surface layer portion of the photosensitive drum, making it impossible to properly read the markings.

On the other hand, with the aforementioned Patent Reference Nos. 1 through 3, while it is possible to prevent meander of the endless belt, there has been the problem that these are all constitutions capable of being applied where the dimension in the width direction of the endless belt is less than the dimension in the width direction of the electrically conductive component, but are not capable of being applied where the dimension in the width direction of the endless belt is greater than the dimension in the width direction of the electrically conductive component.

The present invention was conceived in order to solve such problems, it being an object thereof to provide a transfer apparatus and an image forming apparatus that will make it possible to simultaneously solve both the problem in which developer adhering at either extreme side of endless belt(s) accumulates to form abrasive that abrades surface layer(s) of photosensitive drum(s) as well as the problem in which meander of endless belt(s) occurs.

SUMMARY OF INVENTION

In order to solve one or more of the foregoing and/or other problems, a transfer apparatus in accordance with one or more embodiments of the present invention comprises one or more transfer mechanisms in which image information is developed on one or more electrostatic latent bearing members (e.g., photosensitive drum(s)) through use of developer, application of an electric field to one or more electrically conductive components from one or more backs of at least one of the endless belt or belts causing developer embodying at least a portion of the image information that has been developed to be transferred to paper clinging to and transported by at least one of the endless belt or belts; wherein at least one of the electrically conductive component or components is formed so as to be roller-shaped, either end in a width direction of which is formed from one or more fibrous electrically conductive components (hereinafter "fibrous electrically conductive components"), and at least one central region in the width direction of which is formed from at least one species selected from among the group consisting of at least one elastic rubber material, at least one foamed component, and at least one metal roller-like structure possessing electrical conductivity (hereinafter "metal roller-like structure or the like").

That is, embodiment(s) of the present invention are directed toward transfer apparatus(es) such as may be used for printing of monochromatic images (ordinary black-and-white printing) during which developer is transferred to paper clinging to and transported by endless belt(s). In addition, in accordance with embodiment(s) of the present invention, the ends of at least one of the roller-shaped electrically conductive component(s) may be formed from fibrous electrically conductive component(s), and the central region of at least one of the roller-shaped electrically conductive component(s) may be formed from metal roller-like structure(s) or the like possessing electrical conductivity. In other words, because the fibrous electrically conductive component(s) formed at either respective end of the metal roller-like structure(s) or the like come in contact with either respective side in the width direction of the endless belt(s) that extend past the metal roller-like structure(s) or the like in the central region, application of electric field(s) to the metal roller-like structure(s) or the like also results in application of such electric field(s) to either extreme side of the endless belt(s) that come in contact with the fibrous electrically conductive component(s), as a result of which the endless belt(s) is/are charged with prescribed electric field(s) along the full width(s) thereof. This being the case, because action of the electric field(s) reaches either extreme side of the endless belt(s) when a cleaning technique is carried out in which reverse electric field(s) is/are applied to the endless belt(s) to cause developer adhering thereto to be transferred back to the photosensitive drum(s), it will be the case that developer adhering thereto can be cleaned therefrom. This makes it possible to solve the problem in which developer adhering at either extreme side of the endless belt(s) accumulates and this acts as abrasive to abrade the surface layer(s) of the photosensitive drum(s). As a result, it is also possible to solve the conventional problem in which abrasion of surface layer(s) of the photosensitive drum(s) causes optical signal(s) to be reflected in diffuse fashion at surface layer portion(s) of the photosensitive drum(s), making it impossible to properly read markings.

Furthermore, a transfer apparatus in accordance with one or more embodiments of the present invention comprises one or more transfer mechanisms in which image information is developed on one or more electrostatic latent bearing members (photosensitive drum(s)) through use of developer, application of an electric field to one or more electrically conductive components from one or more backs of at least one of the endless belt or belts causing developer embodying at least a portion of the image information that has been developed to be transferred to at least one of the endless belt or belts; and one or more intermediate transfer rollers pressing against at least one of the endless belt or belts and serving as at least one counterelectrode for at least one of the electrically conductive component or components; wherein either end in a width direction of at least one of the intermediate transfer roller or rollers is formed from one or more fibrous electrically conductive components (hereinafter "fibrous electrically conductive components"); and wherein at least one central region in the width direction of at least one of the intermediate transfer roller or rollers is formed from at least one species selected from among the group consisting of at least one elastic rubber material, at least one foamed component, and at least one metal roller-like structure possessing electrical conductivity (hereinafter "metal roller-like structure or the like").

That is, embodiment(s) of the present invention are directed toward transfer apparatus(es) such as may be used for printing of color images during which developer is transferred to endless belt(s) serving as intermediate transfer belt(s). In addition, in accordance with embodiment(s) of the present invention, the ends of at least one of the intermediate transfer roller(s) serving as counterelectrode(s) for the electrically conductive component or component(s) may be formed from fibrous electrically conductive component(s), and the central region of at least one of the roller-shaped electrically conductive component(s) may be formed from metal roller-like structure(s) or the like possessing electrical conductivity. In other words, because the fibrous electrically conductive component(s) formed at either respective end of the metal roller-like structure(s) or the like come in contact with either respective side in the width direction of the endless belt(s) that extend past the metal roller-like structure (s) or the like in the central region, application of electric field(s) to the metal roller-like structure(s) or the like also results in application of such electric field(s) to either extreme side of the endless belt(s) that come in contact with the fibrous electrically conductive component(s), as a result of which the endless belt(s) is/are charged with prescribed electric field(s) along the full width(s) thereof. This being the case, because action of the electric field(s) reaches either extreme side of the endless belt(s) when a cleaning technique is carried out in which reverse electric field(s) is/are applied to the endless belt(s) to cause developer adhering thereto to be transferred back to the photosensitive drum(s), it will be the case that developer adhering thereto can be cleaned therefrom. This makes it possible to solve the problem in which developer adhering at either extreme side of the endless belt(s) accumulates and this acts as abrasive to abrade the surface layer(s) of the photosensitive drum(s).

The foregoing constitution may be such that at least one width of at least one of the metal roller-like structure(s) or the like in at least one of the central region or regions of at least one of the electrically conductive component or components is not less than at least one width corresponding to the image information formed on at least one of the electrostatic latent bearing member or members (photosensitive drum(s)). Furthermore, the foregoing constitution may be such that at least one width of at least one of the metal roller-like structure(s) or the like in at least one of the central region or regions of at least one of the electrically conductive component or components is not less than at least one width corresponding to the image information formed on at least one of the endless belt or belts.

Moreover, the foregoing constitution may be such that at least one dimension in the width direction of at least one of the fibrous electrically conductive components disposed at either end of at least one of the electrically conductive component or components or of at least one of the intermediate transfer roller or rollers is chosen so as to be not less than a dimension satisfying the following formula: (dimension in the width direction of at least one of the endless belt or belts)≦(dimension in the width direction of at least one of the central region or regions of at least one of the electrically conductive component or components or of at least one of the intermediate transfer roller or rollers)+2×(dimension in the width direction of at least one of the fibrous electrically conductive components). That is, either fibrous electrically conductive component outer end is arranged so as to extend somewhat beyond either endless belt side. This makes it possible for electric field(s) to be applied, and for charging to occur, along the full width(s) of the endless belt(s).

Furthermore, the foregoing constitution may be such that at least one of the electrically conductive component or components is roller-shaped; and at least one fiber length at the fibrous electrically conductive components is chosen so as to cause at least one tip thereof to extend beyond at least one outside circumferential surface of at least one of the roller-shaped electrically conductive component or components This makes it possible for tip(s) of fibrous electrically conductive component(s) to definitively abut inside circumferential surface(s) of endless belt(s), and makes it possible for electric field(s) to be applied in definitive fashion. Furthermore, definitive abutment of inside circumferential surface(s) of endless belt(s) by tip(s) of fibrous electrically conductive component(s) also has the effect of preventing meander in width direction(s) of endless belt(s).

Moreover, the foregoing constitution may be such that at least one fiber length at the fibrous electrically conductive components is such that, when at least one tip thereof comes in contact with at least one of the endless belt or belts, at least one endless belt location contacted thereby is at a height more or less equal to a height of at least one endless belt location contacted by at least one of the central region or regions of at least one of the electrically conductive component or components, such that there is no substantial difference in heights of at least one of the endless belt or belts at at least one of the central region or regions thereof versus at the ends thereof. As a result, it is possible to cause height(s) at which portions of endless belt(s) come in contact with electrically conductive component(s) to, more or less, lie in single plane(s), making it possible to cause endless belt(s) to rotate in stable fashion along the full width(s) thereof.

Furthermore, the foregoing constitution may further comprise one or more meander preventing components arranged at either side of at least one of the endless belt or belts and preventing meander in at least one width direction of at least one of the endless belt or belts; wherein at least one of the meander preventing component or components comes in contact with at least one of the fibrous electrically conductive components. Here, meander preventing component(s) may be ridge(s) provided on inside circumferential surface (s) at sides of endless belt(s). Such protection(s) may be formed in strip-like fashion parallel to sides of endless belt(s) and along the entire perimeter(s) thereof. By thus providing such ridge(s), when fibrous electrically conductive component(s) come in contact with such ridge portion (s), tips of fibrous electrically conductive component(s) is/are bent so as to be more completely folded over, delivering greater load resistance to endless belt(s); and in addition, the two sides of each of such ridge portion(s) are straddled by tips of fibrous electrically conductive component(s), permitting more definitive prevention of meander in width direction(s) of endless belt(s).

Furthermore, the foregoing constitution may be such that at least one of the electrically conductive component or components forms at least one roller; and at least one electrical resistance of at least one of the fibrous electrically conductive components is more or less equal to at least one electrical resistance of at least one of the metal roller-like structure(s) or the like disposed in at least one of the central region or regions of at least one of the electrically conductive component or components forming at least one roller. For example, where central region(s) of electrically conductive component(s) comprise metal roller-like structure(s), electrical resistance of fibrous electrically conductive component(s) might be on the order of $10^3$ Ωcm to $10^4$ Ωcm.

By thus making electrical resistances more or less equal, it is possible to prevent occurrence of difference(s) in charging characteristics at fibrous electrically conductive component(s) present at either end versus at metal roller-like structure(s) or the like present in central region(s).

Alternatively or in addition thereto, the foregoing constitution may be such that at least one of the electrically conductive component or components forms at least one roller; and at least one electrical resistance of at least one of the fibrous electrically conductive components is less than at least one electrical resistance of at least one of the metal roller-like structure(s) or the like disposed in at least one of the central region or regions of at least one of the electrically conductive component or components forming at least one roller. However, electrical resistance(s) of fibrous electrically conductive component(s) might be chosen so as to be within range(s) for which there will not be occurrence of substantial difference(s) in charging characteristics at fibrous electrically conductive component(s) versus at metal roller-like structure(s) or the like. By thus setting lower electrical resistance(s) at fibrous electrically conductive component (s), because this permits stronger electric field(s) to be applied to fibrous electrically conductive component(s), it will be possible to achieve increased tendency for clinging to occur between fibrous electrically conductive component (s) and endless belt(s), permitting more definitive prevention of meander.

Furthermore, by equipping image forming apparatus(es) with transfer apparatus(es) constituted as described above in accordance with embodiment(s) of the present invention, it is possible to achieve image forming apparatus(es) having excellent endurance.

In accordance with embodiment(s) of the present invention as described above, arrangement of fibrous electrically conductive component(s) at end(s) of roller-shaped electrically conductive component(s) applying electric field(s) to endless belt(s) makes it possible to apply electric field(s) along the full width(s) of endless belt(s), permitting improvement in ability to clean developer remaining on endless belt(s), permitting elimination of variation in load in width direction(s) of rotating endless belt(s), and permitting elimination of endless belt meander as well as cracking. That is, because the fibrous electrically conductive component(s) formed at either respective end of the metal roller-like structure(s) or the like come in contact with either respective side of the endless belt(s) that extend past the metal roller-like structure(s) or the like in the central region, application of electric field(s) to the metal roller-like structure(s) or the like also results in application of such electric field(s) to either extreme side of the endless belt(s) that come in contact with the fibrous electrically conductive component(s), as a result of which the endless belt(s) is/are charged with prescribed electric field(s) along the full width(s) thereof. This being the case, because action of the electric field(s) reaches either extreme side of the endless belt(s) when a cleaning technique is carried out in which reverse electric field(s) is/are applied to the endless belt(s) to cause developer adhering thereto to be transferred back to the photosensitive drum(s), it will be the case that developer adhering thereto can be cleaned therefrom. This makes it possible to solve the problem in which developer adhering at either extreme side of the endless belt(s) accumulates and this acts as abrasive to abrade the surface layer(s) of the photosensitive drum(s). Furthermore, in accordance with embodiment(s) of the present invention, contact of either extreme side of endless belt(s) by fibrous electrically conductive component(s) makes it possible to definitively prevent meander in width direction(s) of endless belt(s).

BRIEF DESCRIPTION OF DRAWINGS

FIG. 4 (*a*) is an explanatory diagram showing the situation as viewed from the front. FIG. 4 (*b*) is a cross-sectional view of section A-A; FIG. 4 (*c*) is a cross-sectional view of section B-B.

DESCRIPTION OF PREFERRED EMBODIMENTS

Below, embodiments of the present invention are described with reference to the drawings.

An embodiment of an image forming apparatus equipped with a transfer apparatus in accordance with the present invention will first be described.

Embodiment 1

Figure 1:
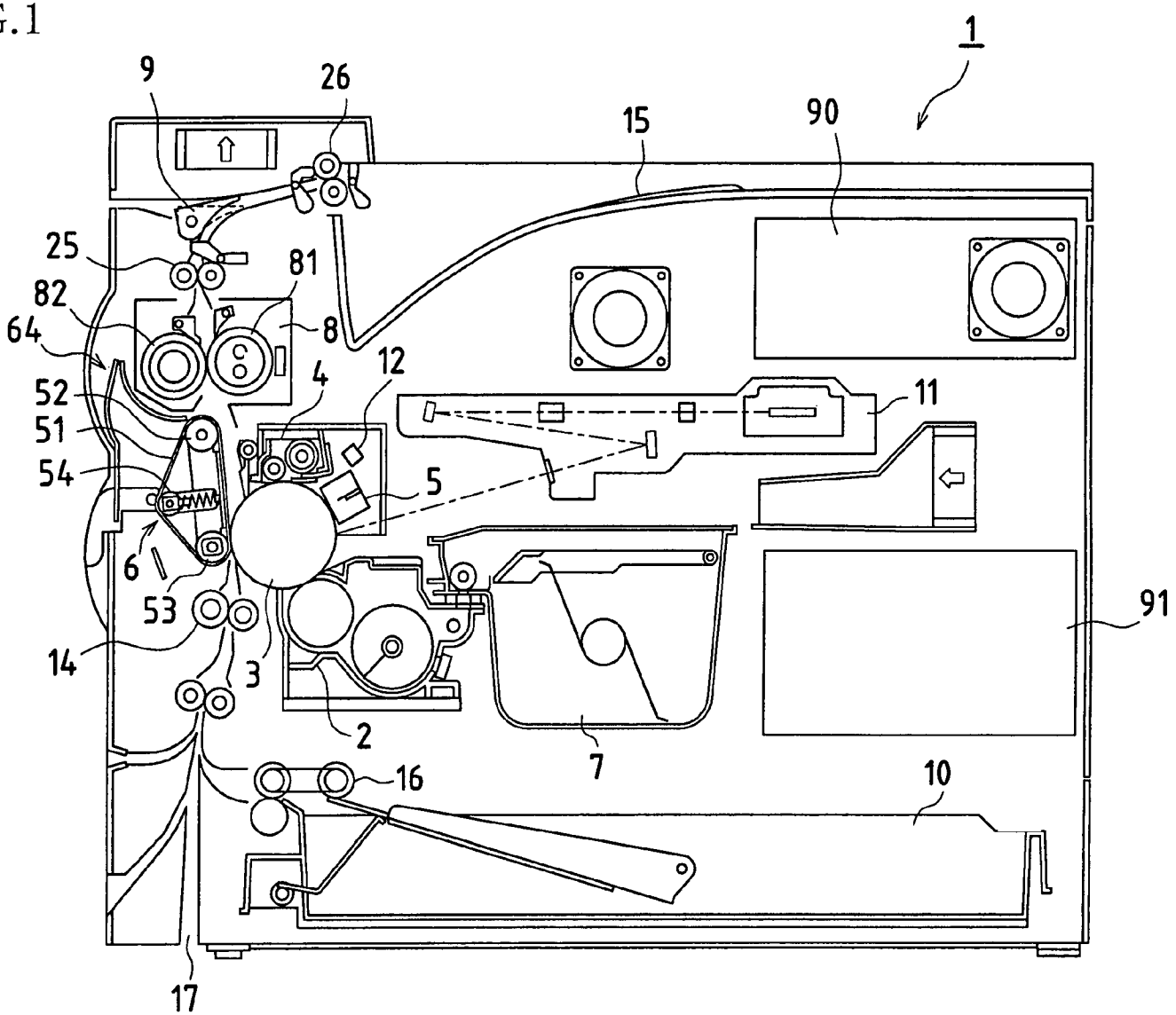
FIG. 1 is an explanatory diagram showing constitution of an image forming apparatus associated with a first embodiment of the present invention.

FIG. 1 is an explanatory diagram showing constitution of an image forming apparatus associated with the present first embodiment.

That is, this image forming apparatus 1 records and outputs in image form images read by image capturing apparatus(es) (read unit(s), not shown) and/or data received from equipment (e.g., personal computer(s) or other such image processing apparatus(es)) externally connected to image forming apparatus 1, and is equipped with transfer apparatus(es) such as may be used for printing of monochromatic images (ordinary black-and-white printing) during which developer (toner) is transferred to paper clinging to and transported by endless belt(s).

At this image forming apparatus 1, respective processing units carrying out various functions for image formation are arranged about photosensitive drum(s) 3, these processing units constituting image forming unit(s). That is, this image forming apparatus 1 is provided with image forming unit(s) in which there are arranged in sequence about photosensitive drum(s) 3: charging unit(s) 5; optical scanning unit(s) 11; development unit(s) 2; transfer unit(s) (what is referred to in the context of the present invention as transfer apparatus (es)) 6; cleaning unit(s) 4; charge-removing lamp(s) 12; and so forth.

Charging unit 5 uniformly charges the surface of photosensitive drum 3. Optical scanning unit 11 causes an optical image to be scanned across the uniformly charged photosensitive drum 3 to write an electrostatic latent image. Development unit 2 uses developer supplied from development supply container(s) 7 to cause the electrostatic latent image on photosensitive drum 3 to develop. Transfer unit 6 transfers to paper the development image that has been developed on photosensitive drum 3. Cleaning unit 4 removes development residue from photosensitive drum 3, making it possible for new image(s) to be recorded on photosensitive drum 3. Charge-removing lamp 12 removes charge from the surface of photosensitive drum 3.

Supply tray 10 is arranged at the lower portion of image forming apparatus 1, being housed within the main body of image forming apparatus 1.

Supply tray 10 is a recording media storage tray, within which paper is stored. Paper stored within supply tray 10 is separated one sheet at a time by takeup roller(s) 16 and so forth and is transported to registration roller(s) 14, registration roller(s) 14 adjusting the timing thereof relative to image transfer processing taking place on photosensitive drum 3, and the paper being sequentially supplied to a region between transfer unit 6 and photosensitive drum 3. Moreover, the development image on photosensitive drum 3 is transferred to paper. Note that replenishment of paper at supply tray 10 is carried out by pulling supply tray 10 outward, toward the front side (operator side) of image forming apparatus 1.

Provided below image forming apparatus 1, having been made available as peripheral equipment, is/are apparatus(es) possessing multiple stacked paper supply trays, not shown, and paper inlet(s) 17 for accepting paper sent thereto from large-capacity recording media supply apparatus(es) or the like which is/are capable of storing a large quantity of paper and for sequentially supplying paper toward image forming unit(s).

Fuser apparatus(es) 8 is/are arranged within image forming apparatus 1, at the upper portion thereof. Fuser apparatus 8 sequentially accepts paper onto which image(s) have been transferred, and employs fuser roller(s) 81, hot roller(s) 82, and so forth to cause development image(s) transferred to paper to be fused thereonto through use of heat and pressure. This makes it possible for development image(s) to be fused onto paper.

Paper onto which image(s) have been fused is transported further upward by transport roller(s) 25, passes through switching gate(s) 9, and is discharged by flipping roller(s) 26 into stacking tray(s) 15.

Arranged in the spaces above and below optical scanning unit 11 are controller(s) 90, which houses circuit board(s) controlling image forming processes, interface board(s) accepting image data from external equipment, and so forth; power supply apparatus(es) 91, which supplies electric power to the various aforementioned interface boards as well as the various units carrying out the respective aforementioned image formation operations; and so forth.

Referring to the side view of FIG. 2, transfer unit 6 will next be described in detail.

Transfer unit 6 is constructed such that transfer/transport belt(s) 51, being endless belt(s), is/are suspended by drive roller(s) 52, transfer roller(s) (what is referred to in the context of the present invention as electrically conductive component(s)) 53, and tension roller(s) 54; paper being transported as it is made to electrostatically cling to transfer/transport belt(s) 51.

Drive roller 52, transfer roller 53, and tension roller 54 are respectively supported so as to permit rotation relative to support frame(s) 55. Furthermore, one end of support frame 55 is folded over to form flat region 55*a*, and pair of projections 55*b* facing the two ends of the shaft of tension roller 54 are provided on this flat region 55*a*, ends of respective coil springs 56 being made to engage with respective projections 55*b* so that these coil springs 56 protrude therefrom. Respective coil springs 56 apply restoring force, directed leftward in FIG. 2 and equivalent to a load of 1.2 kgf per spring for a total of 2.4 kgf, to the two ends of the shaft of tension roller 54, imparting tension to transfer/transport belt 51 via tension roller 54. The width of flat region 55*a* of support frame 55 is approximately equal to that of transfer/transport belt 51, transfer/transport belt 51 being guided thereby such that transfer/transport belt 51 is kept flat.

Drive roller 52 is driven in rotational fashion in the direction indicated by arrow A through action of a motor (not shown), in accompaniment to which transfer/transport belt 51 moves in rotating fashion, paper P being transported by transfer/transport belt 51 within the region from transfer roller 53 to drive roller 52. The speed at which transfer/transport belt 51 moves matches the circumferential speed of photosensitive drum 3.

Furthermore, drive roller 52 can be connected and disconnected from ground by way of switch 65. Switching of this switch 65 is controlled by a main controller, not shown, which controls the overall apparatus.

Furthermore, pair of coil springs 58 protrude from the inside wall of the housing in such manner as to press against the two ends of the shaft of transfer roller 53. Respective coil springs 58 apply restoring force, directed rightward in FIG. 2 and equivalent to a load of 0.5 kgf to 1.5 kgf per spring for a total of 1.0 kgf to 3.0 kgf, to the two ends of the shaft of transfer roller 53. This causes support frame 55 to experience a restoring force that is directed in counterclockwise fashion about the shaft of drive roller 52, causing transfer roller 53 to press against photosensitive drum 3 by way of transfer/transport belt 51. Alternatively, when paper P is transported to the region between transfer unit 6 and photosensitive drum 3, transfer roller 53 presses against photosensitive drum 3 by way of transfer/transport belt 51 and paper P.

Transfer/transport belt 51 has urethane and/or NBR (acrylonitrile-butadiene rubber) as primary constituent, and is formed in endless fashion by extrusion molding, centrifugal molding, or the like. Furthermore, transfer/transport belt 51 is approximately 0.5 mm to 0.65 mm in thickness and possesses electrical conductivity, having volume resistance of $10^8$ Ωcm to $10^{10}$ Ωcm. Moreover, the surface of transfer/transport belt 51 is coated with a fluorine-containing substance.

Transfer roller 53 is formed so as to have an outside diameter on the order of 18 mm, electrically conductive elastic foam layer(s) being provided about a core made up of stainless-steel-and/or iron-type rod stock. Electrically conductive elastic layer(s) might comprise urethane rubber, EPDM (ethylene propylene diene copolymer rubber), and/or the like having a volume resistance on the order of approximately $10^7$ Ωcm and having a JIS-C (Asker C) hardness of 45 to 60. Note that electrically conductive elastic layer(s) at transfer roller 53 is/are not limited to being a single layer but may be a plurality of layers.

Furthermore, transfer bias voltage(s) opposite in polarity to toner charge polarity is/are applied to transfer roller 53 by high-voltage power supply 63 (in the present embodiment, toner being of negative charge polarity, transfer bias voltage will be of positive polarity), such transfer bias voltage(s) being applied from high-voltage power supply 63 through coil springs 58 to the core of transfer roller 53. High-voltage power supply 63 is driven in constant-current fashion such that an internal control circuit causes a current of 20 μA to 40 μA to flow. Because this is driven in such constant-current fashion, the voltage that is applied to transfer roller 53 varies within the range 500 V to 4 kV depending on the quality of paper P and ambient conditions.

Tension roller 54 is a metal roller comprising stainless steel. But note that where transfer unit 6 is to be made large in size, aluminum-type material(s) may be used so that tension roller(s) having large outside diameter(s) can be employed.

Because transfer roller 53 employs rubber-type material (s) having high coefficient(s) of friction and there is no particular need to use rubber roller(s) or the like for drive roller 52, it being possible to use metal-type roller(s) made of stainless steel and/or aluminum for drive roller 52, precision of the outside diameter at this drive roller 52 can be increased and runout thereof can be reduced, improving transportability of transfer/transport belt 51.

Embodiment 2

Figure 3:
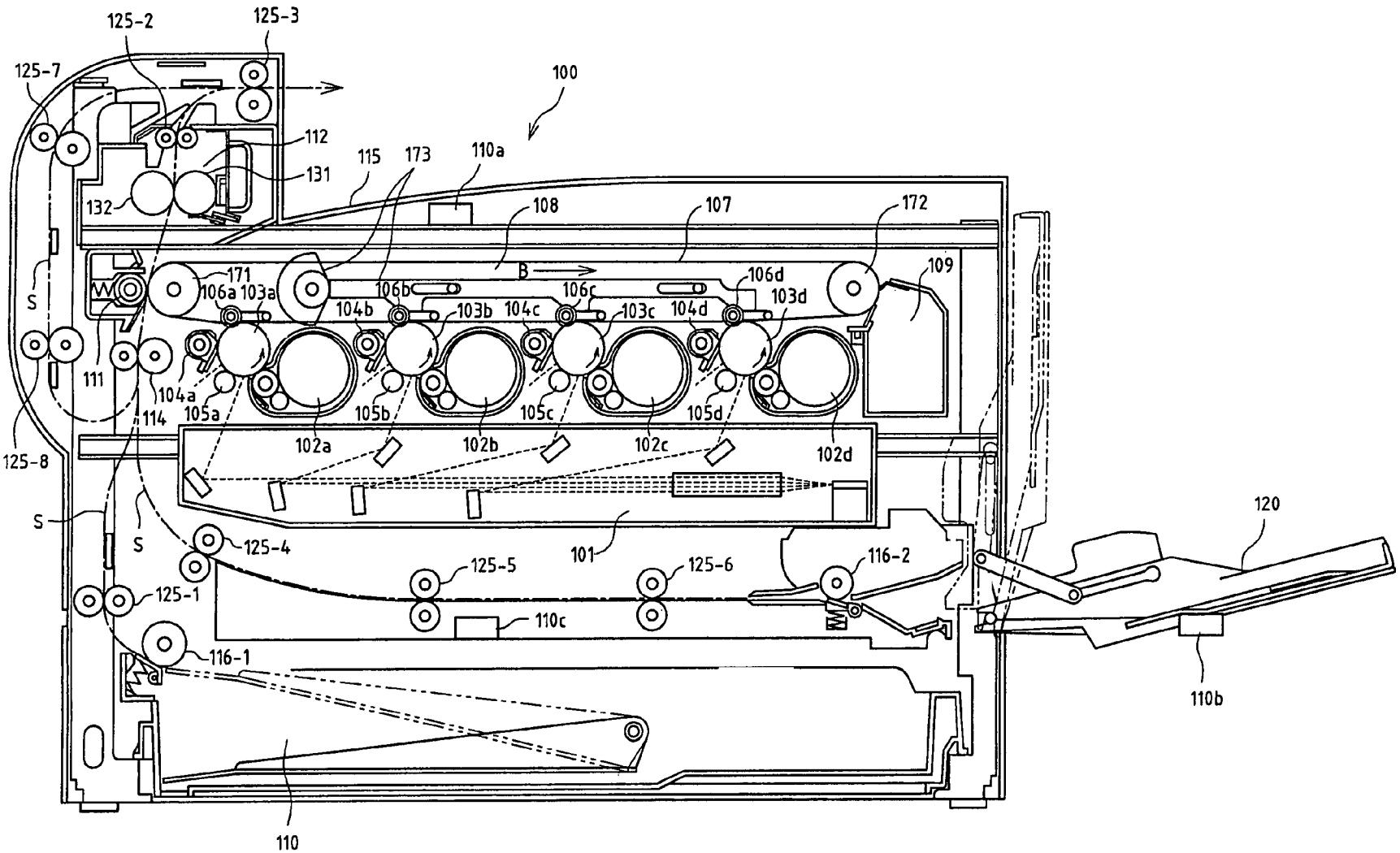
FIG. 3 is an explanatory diagram showing constitution of an image forming apparatus associated with a second embodiment of the present invention.

FIG. 3 is an explanatory diagram showing constitution of an image forming apparatus associated with the present second embodiment.

The present image forming apparatus 100, which forms polychromatic and/or monochromatic images on prescribed paper (recording paper) in correspondence to image data transmitted thereto from the exterior, comprises, as shown in the drawing, exposing unit(s) 101; development unit(s) 102; photosensitive drum(s) 103; cleaning unit(s) 104; charging unit(s) 105; intermediate transfer belt unit(s) (what is referred to in the context of the present invention as transfer apparatus(es)) 108, being endless belt(s); fuser unit(s) 112; paper transport path(s) S; media supply tray(s) 110; discharge tray(s) 115; and so forth.

Moreover, image data handled by the present image forming apparatus 100 corresponds to color images utilizing the respective colors black (K), cyan (C), magenta (M), and yellow (Y). Accordingly, there are four each of development units 102 (102*a*, 102*b*, 102*c*, 102*d*); photosensitive drums 103 (103*a*, 103*b*, 103*c*, 103*d*); charging units 105 (105*a*, 105*b*, 105*c*, 105*d*); and cleaning units 104 (104*a*, 104*b*, 104*c*, 104*d*), these being provided so as to respectively form four latent images in correspondence to the respective colors (refer to reference numerals in parentheses). Four imaging stations are constituted hereby, the letter "a" being appended to reference numerals for black components, the letter "b" being appended to reference numerals for cyan components, the letter "c" being appended to reference numerals for magenta components, and the letter "d" being appended to reference numerals for yellow components.

Photosensitive drum 103 is arranged (loaded) at the upper portion of the present image forming apparatus 100.

Charging unit 105 serves as charging means for uniformly charging the surface of photosensitive drum 103 to prescribed electric potential(s). Note that besides contacting roller-type and brush-type charging units shown in FIG. 3, charger-type charging units may be employed as such charging means.

Besides the technique of using a laser scanning unit (LSU) equipped with a laser-irradiating subassembly and reflecting mirror(s) as shown in FIG. 3, exposing unit 101 may, for example, employ the technique of using EL and/or LED write head(s) in which light-emitting elements are arranged in array-like fashion. Moreover, by exposing charged photosensitive drum 103 in correspondence to image data input thereto, exposing unit 101 has the ability to cause formation of an electrostatic latent image on the surface of photosensitive drum 103 in correspondence to image data.

Development unit 102 uses toner (K, C, M, or Y; depending on the color of the station in question) to cause the electrostatic latent image formed on photosensitive drum 103 to develop.

Cleaning unit 104 removes/recovers toner residue from the surface of photosensitive drum 103 following image develop/transfer.

Intermediate transfer belt unit 108, arranged above photosensitive drum 103, comprises intermediate transfer belt(s) 107, intermediate transfer belt drive roller(s) 171, intermediate transfer belt tension mechanism(s) 173, intermediate transfer belt idler roller(s) 172, intermediate transfer roller (s) 106 (106*a*, 106*b*, 106*c*, 106*d*), and intermediate transfer belt cleaning unit(s) 109.

Intermediate transfer belt drive roller 171, intermediate transfer belt tension rollers 173, intermediate transfer rollers 106, intermediate transfer belt idler roller 172, and so forth suspend and impart tension to intermediate transfer belt 107 and cause this transfer belt 107 to be driven in rotational fashion in the direction indicated by arrow B.

Intermediate transfer rollers 106 are rotatably supported by intermediate transfer roller attachment site(s) at intermediate transfer belt tension mechanism 173 of intermediate transfer belt unit 108, and deliver transfer bias(es) for transfer of toner images from photosensitive drums 103 to intermediate transfer belt 107.

Intermediate transfer belt 107 is provided in such fashion that it comes in contact with respective photosensitive drums 103. Moreover, intermediate transfer belt 107 permits formation of color toner image(s) (polychromatic toner image (s)) thereon through sequential transfer of toner images of respective colors which are formed on photosensitive drums 103 to intermediate transfer belt 107 in superposed fashion. This intermediate transfer belt 107 is formed in endless fashion using film of thickness on the order of 100μ to 150μ.

Transfer of toner images from photosensitive drums 103 to intermediate transfer belt 107 is carried out by intermediate transfer rollers 106, which come in contact with the back of intermediate transfer belt 107. To cause transfer of the toner images, high-voltage transfer bias(es) (high voltage(s) of opposite polarity (+) as charge polarity (−) of toner) are applied to intermediate transfer rollers 106.

Intermediate transfer rollers 106 are rollers in which an electrically conductive elastic material (e.g., EPDM, urethane foam, etc.) covers the surface of a base material in the form of a metal (e.g., stainless steel) shaft of diameter 8 mm to 10 mm. This electrically conductive elastic material makes it possible for high voltage(s) to be uniformly applied to the intermediate transfer belt. Whereas roller-shaped objects are employed as transfer electrodes in the present second embodiment, brush(es) or the like may alternatively or additionally be employed as same.

Thus, electrostatic latent images developed in correspondence to respective color hues on respective photosensitive drums 103 are stacked one atop the other on intermediate transfer belt 107 to become the image information that was input to the apparatus. Rotation of intermediate transfer belt 107 causes image information thus stacked one atop the other to be transferred onto paper by transfer roller 111, which is arranged at the location at which intermediate transfer belt 107 comes in contact with the paper, described below.

At this time, intermediate transfer belt 107 and transfer roller 111 are compressed by virtue of existence of a prescribed nip, and voltage(s) for transferring toner to paper is/are applied to transfer roller 111 (high voltage(s) of opposite polarity (+) as charge polarity (−) of toner). Moreover, so that the foregoing nip is attained in constant fashion, transfer roller 111 is such that either transfer roller 111 or intermediate transfer belt drive roller 171 is made from hard material (metal or the like), and the other comprises elastic roller or other such soft material (elastic rubber roller, foamed resin roller, etc.).

Furthermore, because, as described above, contact with photosensitive drums 103 can cause toner adhering to intermediate transfer belt 107, and/or toner not transferred to paper by transfer roller 111 and remaining on intermediate transfer belt 107, to produce occurrence of color mixing during subsequent operation(s), intermediate transfer belt cleaning unit 109 is installed so as to remove/recover same. Intermediate transfer belt cleaning unit 109 is, for example, equipped with a cleaning blade serving as cleaning member which comes in contact with intermediate transfer belt 107; intermediate transfer belt 107 being supported from the back thereof by intermediate transfer belt idler roller 172 at the approximate location at which the cleaning blade comes in contact with intermediate transfer belt 107.

Media supply tray 110, being a tray for storage of paper (recording paper) used for image formation, is provided below exposing unit 101 and the image forming unit(s) of the present image forming apparatus 100. Furthermore, discharge tray 115 provided at the upper portion of the present image forming apparatus 100 is a tray for accepting face-down placement of paper on which printing has been completed.

Furthermore, the present image forming apparatus 100 is provided with more or less perpendicularly configured paper transport path S for delivering paper from media supply tray 110 to discharge tray 115 by way of transfer roller 111 and fuser unit 112. Moreover, arranged in the vicinity of paper transport path S which extends from media supply tray 110 to discharge tray 115 are takeup roller 116, registration rollers 114, transfer roller 111, fuser unit 112, and transport rollers 125 for transporting the paper, and so forth.

Transport rollers 125 are small rollers for promoting/assisting transport of paper, a plurality thereof being provided along paper transport path S. Takeup roller(s) 116 is/are provided at one end of media supply tray 110, being takeup roller(s) for supplying paper one sheet at a time to paper transport path S from media supply tray 110.

Furthermore, registration rollers 114 temporarily retain paper being transported along paper transport path S. Moreover, registration rollers 114 have the ability to transport the paper to transfer roller 111 with such timing as to cause the lead edge of the paper to be aligned with the lead edges of the toner images on photosensitive drums 103.

Fuser unit 112 is equipped with hot roller(s) 131, pressure roller(s) 132, and so forth; hot roller 131 and pressure roller 132 rotating as the paper is held in the nip formed therebetween.

Furthermore, hot roller 131 is controlled so as to be at prescribed fusing temperature(s) by controller(s) based on signal(s) from temperature detector(s), not shown; and, together with pressure roller 133, is capable of subjecting the paper to thermocompression to cause the polychromatic toner image transferred to the paper to be melted, fused, and compressed, thermocompressively bonding same to the paper.

Moreover, following fusing of the polychromatic toner image thereonto, the paper is transported by transport rollers 125 (125-1 through 125-8) along the flipping discharge route of paper transport path S so as to cause the paper to be discharged into discharge tray 115 in a flipped state (i.e., such that the polychromatic toner image faces down).

Arranged at the present image forming apparatus 100 is automatic-feed cassette 110, storing paper in advance; and also arranged thereat is manual-feed tray 120, obviating the need to carry out open/close operations at the aforementioned automatic-feed cassette 110 when the user is printing a small number of pages.

Both feed methods make use of the takeup roller(s) 116 respectively arranged thereat to guide paper one sheet at a time to paper transport path(s) S.

Paper transported from automatic-feed cassette 110 is transported to registration rollers 114 by transport rollers 125-1 within the transport path, from which it is transported to transfer roller 111 with such timing as to cause the lead edge of the paper to be brought into registration with the lead edges of the image information on intermediate transfer belt 107 to cause image information to be written onto the paper. The paper thereafter passes through fuser unit 112, where the unfused toner on the paper is melted by heating and is fused thereto, and travels via transport rollers 125-2 to where it is discharged therefrom by discharge rollers 125-3 to discharge tray 115. The foregoing are operations such as might take place at the time of a single-sided print request.

On the other hand, paper stacked at manual-feed tray 120 is fed therefrom by takeup roller(s) 116-2 and travels via a plurality of transport rollers (125-6, 125-5, 125-4) to arrive at registration rollers 114, following which it undergoes the same course of events as when paper is supplied from automatic-feed cassette 110, and is discharged onto discharge tray 115. The foregoing are operations such as might take place at the time of a single-sided print request.

On the other hand, when the content of the print request is such as to require double-sided printing, single-sided printing is completed as described above, following which the trail edge of the paper, having passed through fuser unit 112, is held by discharge rollers 125-3; and with the paper in this state, the discharge rollers are made to rotate in reverse fashion so that the paper is guided to transport rollers (125-7, 125-8), following which the paper travels by way of registration rollers 114 and printing is carried out on the back side thereof, and the paper is thereafter discharged into discharge tray 115.

Paper (interleaf) incorporating IC(s) (RFID tag(s)) is placed in advance on manual-feed tray (interleaf tray) 120. Furthermore, sensors (RFID readers) 10*a* through 110*c* are respectively installed at manual-feed tray 120, at arbitrary transport roller(s) in the transport path (for confirming passage at an intermediate point therealong), and at discharge tray 115. The purpose of this is to make it possible to identify at the respective locations where the paper incorporating IC(s) (RFID tag(s)) currently is as it is fed from manual-feed tray 120. In particular, manual-feed tray 120 and/or discharge tray 115 might have sensors equipped with multireader functionality permitting a plurality of sheets to be read at the same time, as a result of which it will be possible to capture information pertaining to individual sheets even when multiple sheets of paper are stacked one atop the other.

Description of Transfer Apparatus Associated with Present Invention

Figure 2:
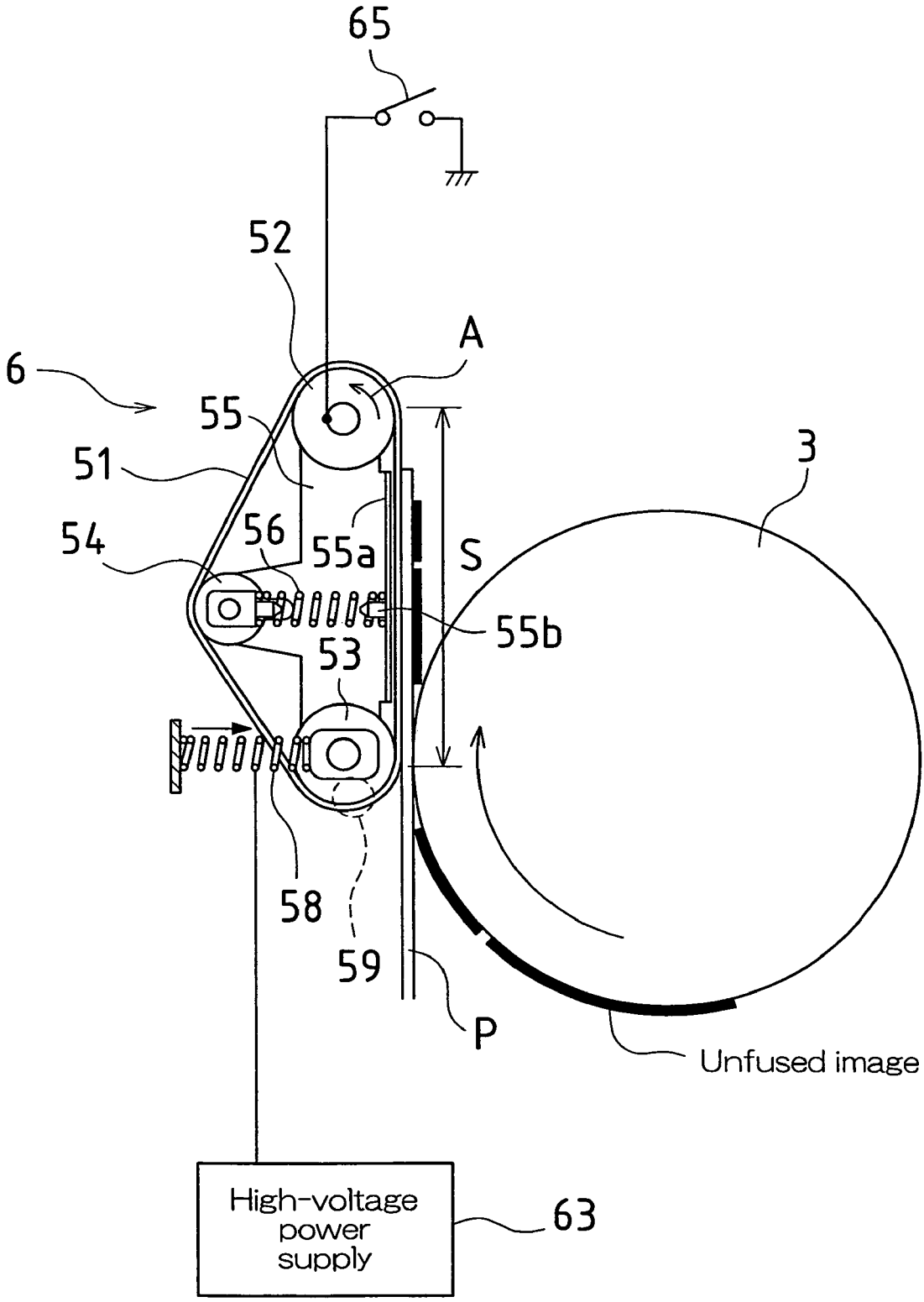
FIG. 2 is an enlarged side view showing the transfer unit portion.
Figures 4, 4B:
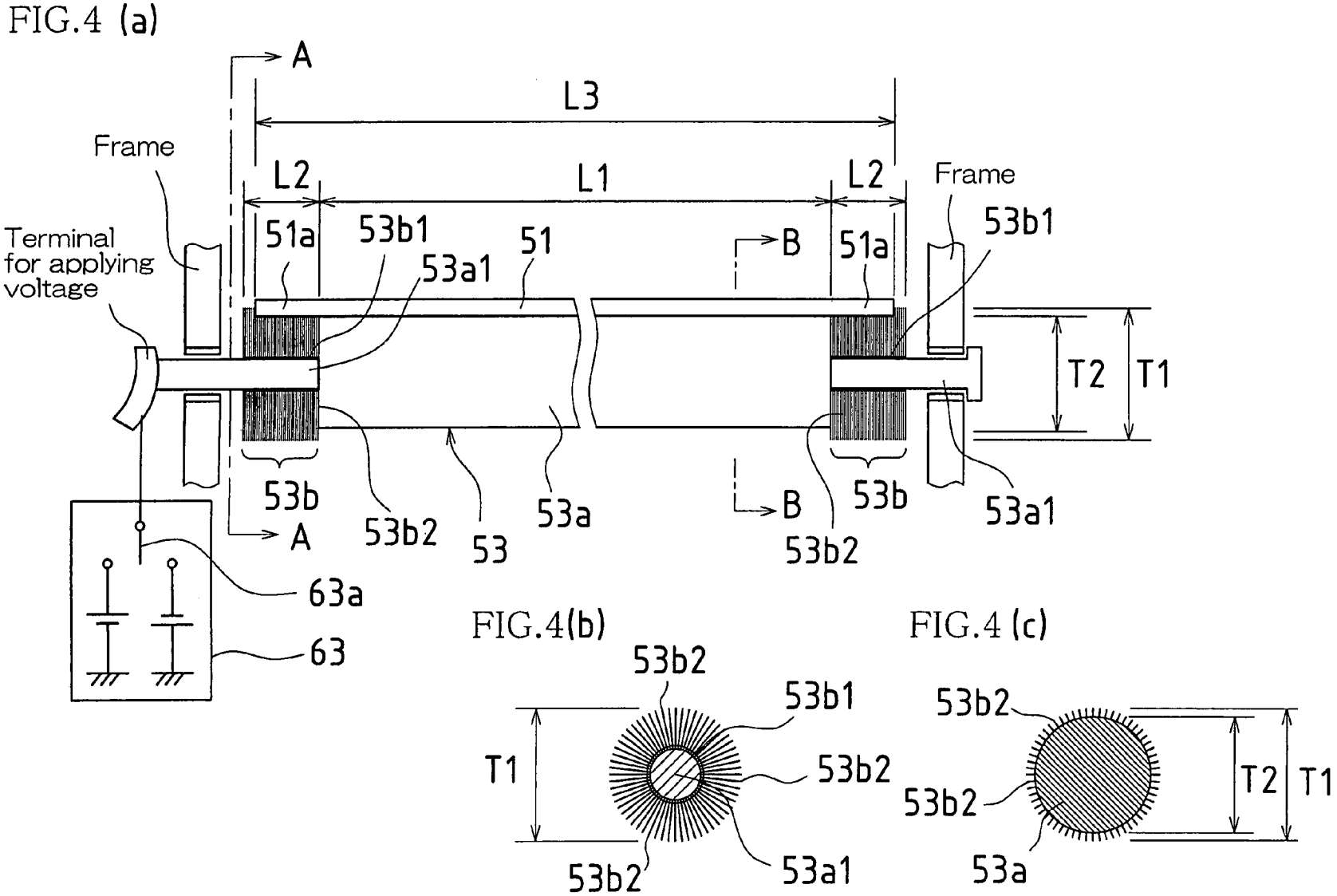
FIG. 4 are explanatory diagrams showing principal parts of a transfer apparatus such as may be used in the image forming apparatus shown in FIGS. 1 and 2 for printing monochromatic images, or the image forming apparatus shown in FIG. 3 for printing polychromatic (i.e., color) images.

FIG. 4 is an explanatory diagram showing principal parts of a transfer apparatus (corresponding to transfer unit 6 in FIGS. 1 and 2, and to intermediate transfer belt unit 108 in FIG. 3) such as may be used in the image forming apparatus shown in FIGS. 1 and 2 for printing monochromatic images, or the image forming apparatus shown in FIG. 3 for printing polychromatic (i.e., color) images. (a) in same drawing is an explanatory diagram showing the situation as viewed from the front; (b) in same drawing is a cross-sectional view of section A-A; (c) in same drawing is a cross-sectional view of section B-B. Note that description of FIG. 4 will be carried out in terms of the example of transfer unit 6 of the image forming apparatus shown in FIGS. 1 and 2; and where necessary, correspondence to intermediate transfer belt unit 108 shown in FIG. 3 will be explicitly mentioned.

At this transfer apparatus, transfer roller 53 (corresponding to intermediate transfer rollers 106 and/or transfer roller 111 in FIG. 4) might be such that either end in the width direction thereof is formed from fibrous electrically conductive components 53*b* (hereinafter "fibrous electrically conductive components"), and a cylindrical portion in the central region in the width direction thereof is, for example, formed from metal roller-like structure(s) (this/these might also be foamed component(s), elastic rubber material(s), and/or the like) 53*a*.

Fibrous electrically conductive components 53*b* are each constructed such that, for example, a multiplicity of individual fibers 53*b*2 possessing electrical conductivity are densely implanted on electrically conductive felt base material 53*b*1, electrically conductive adhesive being used to adhesively secure this felt base material 53*b*1 to rotatable support shaft 53*a*1 of metal roller-like structure 53*a* as felt base material 53*b*1 is wound in helical fashion about rotatable support shaft 53*a*1.

Here, dimension L2 in the width direction of each fibrous electrically conductive component 53*b* is chosen so as to be not less than a dimension satisfying the following formula:

(dimension *L*3 in width direction of transfer/transport belt 51)≦(dimension *L*1 in width direction of metal roller-like structure 53*a*)+2×(dimension *L*2 in width direction of fibrous electrically conductive component 53*b*) (1)

That is, the outer ends of fibrous electrically conductive components 53*b* are arranged so as to extend somewhat beyond the extreme sides 51*a* of transfer/transport belt 51. This makes it possible for electric field(s) to be applied, and for charging to occur, along the full width of transfer/transport belt 51.

That is, because fibrous electrically conductive components 53*b* formed at either respective end of metal roller-like structure 53*a* come in contact with either extreme side 51*a* of transfer/transport belt 51 (corresponding to intermediate transfer belt 107 in FIG. 3) that extend past the ends of metal roller-like structure 53*a* in the central region, application of electric field(s) to metal roller-like structure 53*a* also results in application of such electric field(s) to the extreme sides 51*a* of transfer/transport belt 51 that come in contact with fibrous electrically conductive components 53*b*, as a result of which transfer/transport belt 51 is charged with prescribed electric field(s) along the full width thereof.

Furthermore, outside diameter T1 approximated by tips of respective individual fibers 53*b*2 of fibrous electrically conductive components 53*b* is somewhat larger than diameter T2 of metal roller-like structure 53*a*. That is, the constitution is such that when tips of respective individual fibers 53*b*2 come in contact with transfer/transport belt 51, transfer/transport belt 51 is subjected to some degree of pressure from fibrous electrically conductive components 53*b*, i.e., is subjected to some degree of frictional resistance during rotation. This makes it possible for tips of individual fibers 53*b*2 to definitively abut the inside circumferential surface of transfer/transport belt 51, and makes it possible for electric field(s) to be applied in definitive fashion. Furthermore, definitive abutment of the inside circumferential surface of transfer/transport belt 51 by tips of individual fibers 53*b*2 also has the effect of preventing meander in the width direction of transfer/transport belt 51.

Moreover, individual fibers 53*b*2 are of length(s) causing same to be at a height more or less equal to the height at which metal roller-like structure 53*a* is contacted by transfer/transport belt 51 (i.e., to be more or less at the same height as the contact surface between transfer/transport belt 51 and metal roller-like structure 53*a*); i.e., individual fibers 53*b*2 are of such length(s) that there is no substantial difference in height along the width direction of transfer/transport belt 51, i.e., where transfer/transport belt 51 comes in contact with metal roller-like structure 53*a* versus where transfer/transport belt 51 comes in contact with fibrous electrically conductive components 53*b*. Note that in practice, however, the actual length to be used for the individual fibers will depend on the hardness of the individual fibers and the density with which they are implanted, the hardness of transfer/transport belt 51, and so forth. As a result, it is possible to cause the heights at which portions of transfer/transport belt 51 come in contact with transfer roller 53 to, more or less, lie in a single plane, making it possible to cause transfer/transport belt 51 to rotate in stable fashion along the full width thereof.

In addition, the width of metal roller-like structure 53*a* is not less than a width corresponding to the image information formed on photosensitive drums 3 (e.g., at the image forming apparatus shown in FIG. 3, not less than a width corresponding to the image information formed on intermediate transfer belt 107).

Furthermore, electrical resistance of fibrous electrically conductive component(s) 53*b* might be made to be more or less equal to electrical resistance of metal roller-like structure 53*a*. By thus making electrical resistances more or less equal, it is possible to prevent occurrence of problematic situations in which there is/are difference(s) in charging characteristics at fibrous electrically conductive components 53*b* versus at metal roller-like structure 53*a*.

Alternatively or in addition thereto, electrical resistance of fibrous electrically conductive component(s) 53*b* might be made to be less than electrical resistance of metal roller-like structure 53*a*. However, electrical resistances of fibrous electrically conductive components 53*b* are chosen so as to be within a range for which there will not be occurrence of substantial difference(s) in charging characteristics at fibrous electrically conductive components 53*b* versus at metal roller-like structure 53*a*. By thus setting lower electrical resistance(s) at fibrous electrically conductive component(s) 53*b*, because this permits stronger electric field(s) to be applied to fibrous electrically conductive component(s) 53*b*, it will be possible to achieve increased tendency for clinging to occur between fibrous electrically conductive component(s) 53*b* and transfer/transport belt 51, permitting more definitive prevention of meander.

Figure 5:
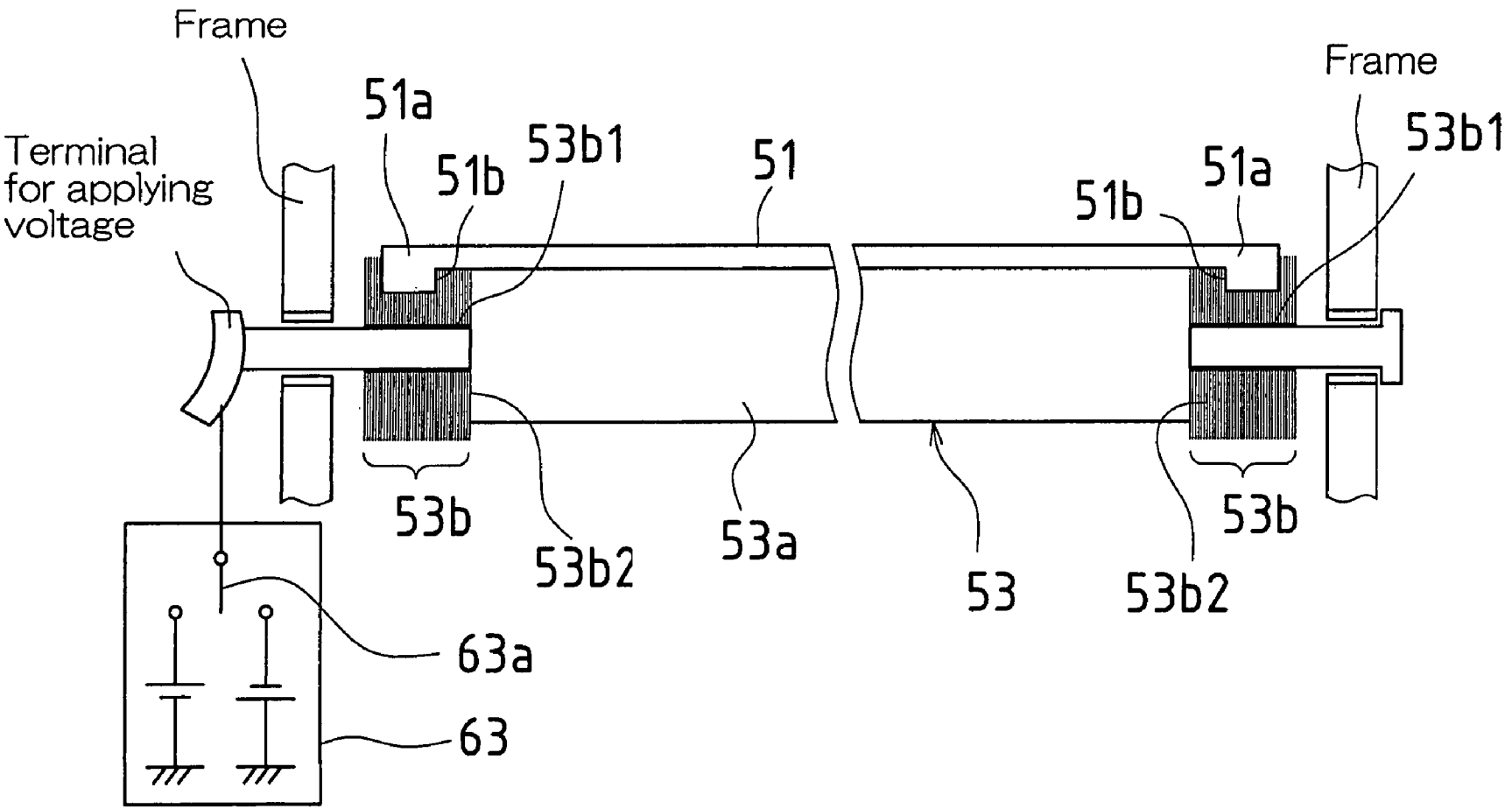
FIG. 5 is an explanatory diagram showing another example of the constitution of a transfer apparatus.

FIG. 5 shows another example of the constitution of a transfer apparatus.

The transfer apparatus shown in FIG. 5 is constituted such that provided at either extreme side 51*a* of transfer/transport belt 51 there are ridges 51*b* serving as meander preventing components for preventing meander in the width direction, these ridges 51*b* coming in contact with fibrous electrically conductive components 53*b*. Here, ridges 51*b* are provided on the inside circumferential surface at the sides of transfer/transport belt 51, being formed in strip-like fashion parallel to the sides of transfer/transport belt 51 and along the entire perimeter thereof. By thus providing such ridges 51*b*, when individual fibers 53*b*2 of fibrous electrically conductive components 53*b* come in contact with such ridges 51*b*, tips of individual fibers 53*b*2 of fibrous electrically conductive components 53*b* are bent so as to be more completely folded over, delivering greater load resistance to transfer/transport belt 51; and in addition, the two sides of each of such ridges 51*b* being straddled by tips of individual fibers 53*b*2, more definitive prevention of meander in the width direction of transfer/transport belt 51 is permitted.

Moreover, high-voltage power supply 63 shown in FIG. 2 is provided with switch 63*a* for internally switching polarity thereof as shown in FIGS. 4 and 5 so as to permit application of reverse electric field(s) to transfer/transport belt 51. This being the case, because action of the electric field(s) reaches either extreme side 51*a* of transfer/transport belt 51 when a cleaning technique is carried out in which reverse electric field(s) is/are applied to transfer/transport belt 51 to cause toner adhering thereto to be transferred back to photosensitive drum(s) 3, it will be the case that toner adhering thereto can be cleaned therefrom. This makes it possible to solve the problem in which toner adhering at either extreme side 51*a* of transfer/transport belt 51 accumulates and this acts as abrasive to abrade surface layer(s) of photosensitive drum(s) 3. As a result, it is also possible to solve the conventional problem in which abrasion of surface layer(s) of photosensitive drum(s) 3 causes optical signal(s) to be reflected in diffuse fashion at surface layer portion(s) of photosensitive drum(s) 3, making it impossible to properly read markings embedded in photosensitive drum(s) 3.

Moreover, the present invention may be embodied in a wide variety of forms other than those presented herein without departing from the gist or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A transfer apparatus employing one or more endless belts, the transfer apparatus comprising:

one or more transfer mechanisms in which image information is developed on one or more electrostatic latent bearing members through use of developer, application of an electric field to one or more electrically conductive components from one or more backs of at least one of the endless belt or belts causing developer embodying at least a portion of the image information that has been developed to be transferred to paper clinging to and transported by at least one of the endless belt or belts;

wherein at least one of the electrically conductive component or components is formed so as to be roller-shaped, either end in a width direction of which is formed from one or more fibrous electrically conductive components, and at least one central region in the width direction of which is formed from at least one species selected from among the group consisting of at least one elastic rubber material, at least one foamed component, and at least one metal roller-like structure possessing electrical conductivity, wherein at least one dimension in the width direction of at least one of the fibrous electrically conductive components disposed at either end of at least one of the electrically conductive component or components is chosen so as to be not less than a dimension satisfying the following formula: (dimension in the width direction of at least one of the endless belt or belts)≦(dimension in the width direction of at least one of the central region or regions of at least one of the electrically conductive component or components)+2×(dimension in the width direction of at least one of the fibrous electrically conductive components).

2. A transfer apparatus employing one or more endless belts according to claim 1 wherein at least one width of at least one of the species selected from among the group consisting of at least one elastic rubber material, at least one foamed component, and at least one metal roller-like structure in at least one of the central region or regions of at least one of the electrically conductive component or components is not less than at least one width corresponding to the image information formed on at least one of the electrostatic latent bearing member or members.

3. A transfer apparatus employing one or more endless belts according to any of claims 1 or 2 wherein at least one of the electrically conductive component or components is roller-shaped; and at least one fiber length at the fibrous electrically conductive components is chosen so as to cause at least one tip thereof to extend beyond at least one outside circumferential surface of at least one of the roller-shaped electrically conductive component or components.

4. A transfer apparatus employing one or more endless belts according to any of claims 1 or 2 wherein at least one fiber length at the fibrous electrically conductive components is such that, when at least one tip thereof comes in contact with at least one of the endless belt or belts, at least one endless belt location contacted thereby is at a height substantially equal to a height of at least one endless belt location contacted by at least one of the central region or regions of at least one of the electrically conductive component or components, such that there is no substantial difference in heights of at least one of the endless belt or belts at at least one of the central region or regions thereof versus at the ends thereof.

5. A transfer apparatus employing one or more endless belts according to any of claims 1 or 2 further comprising:

one or more meander preventing components arranged at either side of at least one of the endless belt or belts and preventing meander in at least one width direction of at least one of the endless belt or belts;

wherein at least one of the meander preventing component or components comes in contact with at least one of the fibrous electrically conductive components.

6. A transfer apparatus employing one or more endless belts according to any of claims 1 or 2 wherein at least one of the electrically conductive component or components forms at least one roller; and at least one electrical resistance of at least one of the fibrous electrically conductive components is more or less equal to at least one electrical resistance of at least one of the species selected from among the group consisting of at least one elastic rubber material, at least one foamed component, and at least one metal roller-like structure possessing electrical conductivity disposed in at least one of the central region or regions of at least one of the electrically conductive component or components forming at least one roller.

7. A transfer apparatus employing one or more endless belts according to any of claims 1 or 2 wherein at least one of the electrically conductive component or components forms at least one roller; and at least one electrical resistance of at least one of the fibrous electrically conductive components is less than at least one electrical resistance of at least one of the species selected from among the group consisting of at least one elastic rubber material, at least one foamed component, and at least one metal roller-like structure possessing electrical conductivity disposed in at least one of the central region or regions of at least one of the electrically conductive component or components forming at least one roller.

8. An image forming apparatus equipped with one or more transfer apparatuses employing one or more endless belts according to any of claims 1 or 2.

9. An image forming apparatus equipped with one or more transfer apparatuses employing one or more endless belts according to claim 3.

10. An image forming apparatus equipped with one or more transfer apparatuses employing one or more endless belts according to claim 4.

11. An image forming apparatus equipped with one or more transfer apparatuses employing one or more endless belts according to claim 5.

12. An image forming apparatus equipped with one or more transfer apparatuses employing one or more endless belts according to claim 6.

13. An image forming apparatus equipped with one or more transfer apparatuses employing one or more endless belts according to claim 7.

* * * * *